US006827436B2

(12) United States Patent
Nitta et al.

(10) Patent No.: US 6,827,436 B2
(45) Date of Patent: Dec. 7, 2004

(54) INK JET RECORDING APPARATUS

(75) Inventors: Tetsuhiro Nitta, Kanagawa (JP); Nozomu Nishiberi, Kanagawa (JP); Shinya Sonoda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/442,580

(22) Filed: May 22, 2003

(65) Prior Publication Data

US 2003/0227532 A1 Dec. 11, 2003

(30) Foreign Application Priority Data

Jun. 7, 2002 (JP) ..... 2002-167016

(51) Int. Cl.[7] ..... B41J 29/13; B41J 2/01; B41J 3/39; B65H 3/52

(52) U.S. Cl. ..... 347/108; 347/104; 400/691; 271/104; 271/121

(58) Field of Search ..... 400/691–693, 400/496, 642, 683, 684; 271/9.06, 9.11, 104, 109, 117, 121; 347/108, 3, 4, 104

(56) References Cited

U.S. PATENT DOCUMENTS 4,419,674 A * 12/1983 Bahl et al. ..... 347/76
6,378,997 B1 * 4/2002 Nitta ..... 347/85
6,634,819 B2 * 10/2003 Uchida ..... 400/691
6,651,974 B2 * 11/2003 Kawarama et al. ..... 271/121

FOREIGN PATENT DOCUMENTS

JP 2001-246759 9/2001

* cited by examiner

*Primary Examiner*—An H. Do
(74) *Attorney, Agent, or Firm*—Fitzpatrick, Cella, Harper & Scinto

(57) ABSTRACT

A recording apparatus is capable of recording images in high quality by supporting and operating each member in good precision despite the use of inexpensive and simple structure for the supporting member thereof. A recording unit is provided with a chassis made in the form of a box as a whole by folding the upper and lower edge portions and the right-hand side of a plate member. For the recording unit, a carriage is slidably supported with a guiding portion formed by folding the upper and lower edge portions of the chassis functioning as the supporting member. Also, a pinch roller holder is axially supported to support the pinch roller axially. To the base of the base unit, a carrier roller and a sheet-expeller roller are axially supported. The recording unit and the base unit are connected with each other.

11 Claims, 10 Drawing Sheets

INK JET RECORDING APPARATUS

BACKGROUND OF THE INVENTION

1. Field of the Invention

The present invention relates to a serial type recording apparatus. More particularly, the invention relates to an ink jet recording apparatus using for the ink jet head thereof an ink jet recording head that performs recording by discharging liquid, such as ink.

2. Related Background Art

For the recording apparatus, which is used as a printer, a recording unit for a copying machine or the like, it is generally practiced to adopt a serial type recording apparatus, that is, the one structured to record images on a recording medium in such a manner that while a sheet type recording medium, such as a recording paper sheet, or an OHP sheet, is being pinched for conveyance, the recording head, which is arranged on the carrying path of the recording medium, is allowed to scan. Of the recording apparatuses of the kind, the recording apparatus that uses the ink jet recording method makes running costs lower with a lesser amount of noises. Also, with such advantages that the apparatus can be downsized and arranged for color use with ease, it is used widely in general.

For the ink jet recording apparatus, the mechanism that conveys a recording medium while pinching it, the mechanism that records on the recording medium, the mechanism that expels the recording medium after the completion of recording, and the like are disclosed in the specifications of Japanese Patent Application Laid-Open No. 2001-246759 and others, for example. FIG. 9 and FIG. 10 are views that schematically illustrate the conventional example of such ink jet recording apparatus. FIG. 9 is a side view that schematically shows the entire body of the ink jet recording apparatus. FIG. 10 is a perspective view that shows the printer unit 520 that forms the principal part of this ink jet recording apparatus. Here, for convenience's sake, the description will be made with the assumption that the side having a sheet-expeller tray 518 provided for the apparatus is in the front in the descriptions given below.

The printer unit 520 is formed by a plate member having a rear wall that expands almost at right angles to the bottom face of the bottom case 519, that is, the installation face of the recording apparatus, and side walls formed by folding the edge portions on both sides of this rear wall. It has the chassis 501 in the U-letter form as a whole (see FIG. 10). The chassis 501 is fixed to the bottom case 519 (see FIG. 9). Between the side walls of the chassis 501, there are supported the guide shaft 504 almost in parallel to the bottom face of the bottom case 519. With the guide shaft 504, and a guide portion arranged on the upper end of the chassis 501, a carriage 506 is supported to be able to reciprocate almost in parallel to the bottom face of the bottom case 519. For the carriage 506, a driving belt 510 is connected to enable the carriage 506 to reciprocate when the driving belt 510 moves circularly by means of a CR motor (not shown).

The carriage 506 has a recording head 508 mounted thereon in such a manner that the discharge port formation surface of the recording head is placed downward with the portion where the discharge port formation surface is provided is extruded downward. On the face of the carriage 506 on the rear side, there is provided a base plate 534 having the circuit that controls the operation of the recording head 508 arranged therefor. In front of the rear sidewall of the chassis 501, an encoder 507 is arranged in a stage of being biased.

With this encoder 507 and a sensor (not shown) provided for the base plate on the carriage, the position of the carriage 506 is detected. The positional signal thus detected for the carriage 506 is utilized for the operational control of the carriage 506, and the recording head 508 as well.

On the backside of the chassis 501, an automatic sheet-feeding unit 517 is arranged on the bottom case 519. The automatic sheet-feeding unit 517 is provided so as to enable a pressure plate 426 and a sheet-feeding tray 527 to stand diagonally backward, on which plural sheets of recording medium 524 are stacked. The pressure plate 526 is fixed to the ASF base 525, which is installed on the bottom case 519 rotatively around the upper edge portion of the pressure plate 526, and the lower edge portion thereof is rotatively biased in the direction toward the front (in the clockwise direction in FIG. 9). Then, the sheet-feeding roller 528, which is axially and rotatively supported to the ASF base 525, is arranged in a position where the lower edge portion of the stacked recording medium 524 is pressed by the pressure plate 526 thus rotatively biased. A separation roller 529 is arranged in a position opposite to the sheet-feeding roller 528.

The sheet-feeding roller 528 is connected with a driving source (not shown), and it is driven to rotate for feeding a recording medium 524 when the recording operation begins. The pressure plate 526 is structured so that it is interlocked with the sheet-feeding roller 528 by means of a cam (not shown). Then, when a feeding is executed, it presses the recording medium 524 to the sheet-feeding roller 528, and on standby, it is pushed back against the biasing force given to it in the direction in which the lower edge portion thereof is placed backward. Therefore, on standby, the recording medium 524 can be stacked on the pressure plate 526 or removed freely. The recording medium thus stacked is held in a state where the lower edge thereof abuts against the rib, which is arranged for the ASF base 525.

At the time of sheet feeding, the separation roller 529 operates so that the recording medium 524 on the separation roller side is not allowed to be fed any further when plural sheets of recording medium 524 are inserted into a nip between the separation roller 529 and the sheet-feeding roller 528. Then, the recording medium 524 is separated and fed one by one from the automatic sheet-feeding unit 517.

In a location where the front edge of a recording medium 524 to be fed is bitten, there are arranged in the positions each other, the carrier roller 502 and the pinch roller 503, which are axially supported to rotate, respectively. The carrier roller 502 is axially supported by the bearings 512 formed on the sidewalls of the chassis 501, respectively. The pinch roller 503 is fixed to the pinch roller holder 513, which axially supports the pinch roller 503 on one end side, while being axially and rotatively supported between the sidewalls of the chassis 501 on the other end side. The pinch roller holder 513 is rotatively biased whereby to press the pinch roller 503 to the carrier roller 502.

The carrier roller 502 is connected with an LF motor (not shown), and the recording medium 524, which is pinched in the nip between the carrier roller 502 and the pinch roller 503, is conveyed by the rotation of the carrier roller 502. In this way, the recording medium 524 is conveyed in the sub-scanning direction intersecting with or orthogonal, in particular, to the main scanning direction in which the carriage 506 reciprocates.

Underneath the passage where the recording medium 524 is conveyed in such a manner, a platen 516 is arranged in a position opposite to the discharge port formation surface of the recording head 508 on the carriage 506 that reciprocates. The platen 516 is axially supported to rotate between the sidewalls of the chassis 501. In front of the platen 516, there are arranged the sheet-expeller roller 511 and the spur 514, which are axially supported to rotate, respectively. The spur 514 is biased by means of a spring toward the sheet-expeller roller 511. The sheet-expeller roller 511 is axially supported by a member that forms the platen 516, and then, connected with the LF motor through gears (not shown) so that it is interlocked with the carrier roller 502. The passage of the recording medium 524 being conveyed by the carrier roller 502 and the sheet-expeller roller 511 is arranged to extend almost in parallel to the bottom face of the bottom case 519.

Then, a sheet-expeller tray 518 is arranged in the position where the recording medium 524, which is pinched in the nip between the sheet-expeller roller 511 and the spur 514, is led out by the rotation of the sheet-expeller roller 511. The sheet-expeller tray 518 is arranged to extend diagonally forward and upward from the lower end of the bottom case 519 to the height of the sheet surface of the recording medium 524 to be conveyed on the platen 516.

In the traveling passage of the carriage 506, the right-hand end thereof is set at the home position, and then, suction recovery means 515 is provided for a portion below the location where the carriage 506 stays at this home position. The suction recovery means 515 is provided with a cap to cover the nozzles open to the discharge port formation surface of the recording head 508, and negative pressure generating means for making the inside of the cap negatively pressurized. The suction recovery means 515 sucks a certain amount of liquid from the nozzles, thus removing mixed dust particles and the ink the viscosity of which is made higher due to dryness. In this way, it functions to prevent the occurrence of such problem as to clog nozzles, which may be brought about by them otherwise. Also, this means is used for filling liquid in the nozzles in good condition. Also, for the suction recovery means 515, wiping means is provided for removing dust particles adhering to the discharge port formation surface by wiping them off from that surface.

The suction recovery means 515 and the automatic sheet-feeding unit 517 are arranged by positioning them in the predetermined positions with respect to the printer unit 520.

In accordance with the structure formed by use of the conventional art, which has been described above, most of the members that form all the mechanisms, such as the one used for recording, conveying a recording medium 524, and expelling the sheet, are incorporated in the printer unit 520. As a result, the chassis 501 of the printer unit 520 is given a heavy load due to the necessity of supporting the members needed for the provision of such mechanisms. If the strength and rigidity of the chassis 501 should be insufficient, it is conceivable that adverse effect is produced on the quality of recorded images due to the disturbance that may take place in the recording positions on a recording medium 524. Therefore, it is required for the chassis 501 to be sufficiently strong and rigid. This is one of the causes that increase the costs of the apparatus.

SUMMARY OF THE INVENTION

Now, with the improvement of the conventional art, the present invention is designed to aim at the provision of a recording apparatus of serial type, an ink jet recording apparatus, in particular, for which an inexpensive and simple structure can be used as the supporting member, while being capable of forming images in high quality without producing any adverse effect on the recorded images on a recording medium.

In order to achieve the aforesaid object, the recording apparatus of the present invention comprises a carrier roller rotatively and axially supported and driven to rotate for pinching and conveying a recording medium, and a pinch roller rotatively and axially supported to face the carrier roller; and a carriage supported above the recording medium to be conveyed, which is capable of reciprocating in the direction intersecting the conveying direction of the recording medium. The recording apparatus repeats the conveyance of the recording medium per designated amount, and the recording of images in the area of a designated width on the recording medium by the recording head mounted on the carriage, while enabling the carriage to reciprocate. The recording apparatus further comprises an assembled body having connected a base unit for axially supporting the carrier roller with a recording unit for supporting the carriage and the pinch roller, and the recording unit is provided with a chassis made in the form of a box as a whole by folding the upper and lower edge portions of a plate member, and also, by folding at least one of the ends thereof, and the carriage and the pinch roller are supported by the chassis.

With the structure thus arranged, the recording unit and the base unit dividedly support the carriage, the carrier roller, and the pinch roller. Therefore, as compared with the conventional example of supporting them with one member, the load, which is given to each of the supporting members of the recording unit and the base unit, can be reduced. Further, as the supporting member of the recording unit, a chassis made in the form of a box by folding the end portions of a plate material can be used, hence making it possible to obtain comparatively high strength and rigidity with a comparatively simple and inexpensive structure. Then, with the connection of a highly strong chassis with the base unit, it becomes possible to reinforce the base unit.

It is possible for the recording apparatus of the present invention to further comprise a sheet-feeding tray enabling the recording medium to be stacked thereon; and a sheet-feeding roller for feeding one of the recording medium stacked on the sheet-feeding tray one by one to a nip between the carrier roller and the pinch roller, in which one end of the sheet-feeding roller is axially supported by the recording unit, and the other end thereof is axially supported by the base unit. In this way, the recording unit and the base unit can share and bear the loads given by the sheet-feeding roller to them for the reduction thereof.

The carriage may be structured and slidably supported to reciprocate with the folded parts of the upper and lower edge portions of the chassis serving as a guiding portion therefor. With the structure thus arranged, it becomes possible to reduce the number of parts and attempt simplifying the apparatus, because there is no longer a need for the provision of a guide shaft required for the conventional art.

As described earlier, the connection with the chassis reinforces the base unit. Therefore, a comparatively low-strength material can be used for the supporting member thereof. Particularly, for the base that becomes the supporting member for the base unit, it is possible to adopt the inexpensive resin mold material that can be formed in various shapes with ease.

The recording unit and the base unit may be connected so as not to change the relative positions to each other, but may be connected through a connecting shaft so as to enable them to rotate relatively around the shaft. In either case, it is possible to obtain the reinforcement of the base unit with the connection with the chassis. Also, in the latter case, the recording unit and the base unit are enabled to rotate relatively around the connecting shaft to make it possible to locate them in a position having the carrier roller and the pinch roller arranged to face each other, and a position of the carrier roller and the pinch roller being apart from each other. With the structure thus arranged, it becomes possible to remove a jammed recording medium with ease by placing the carrier roller and the pinch roller to be in a state of being separated when paper jamming or the like occurs.

Also, for the recording apparatus of the present invention, it may be possible to arrange so that the chassis further supports a ring type driving belt connected with the carriage; plural pulleys having the driving belt being tensioned round them; biasing means for biasing at lest one of the pulleys in the direction to given tension to the driving belt; and a driving motor connected with one of the pulleys. With this structure, therefore, it is made possible to enable the carriage to reciprocate by driving the driving motor. Then, for the chassis, a belt stopper may be formed, which is provided with the wall face positioned with a designated gap to the outer circumferential surface of the pulley connected with the driving motor for at least a part of the portion having the driving belt tensioned. With the provision of such belt stopper, it becomes possible to prevent the driving belt from floating in the circumferential direction of the pulleys. It is advantageous to form this belt stopper so as to abut against a part of the carriage when the carriage moves beyond a designated area in the sliding direction thereof. In this manner, the carriage can be prevented from moving beyond the designated area.

As described above, the recording apparatus of the present invention is provided with the simple and inexpensive supporting members, but structured to be highly strong, hence making it possible to operate each unit in good precision for a precise recording operation. The characteristics of the kind are particularly desirable for an ink jet recording apparatus having an ink jet recording head mounted thereon to discharge liquid. The present invention is preferably applicable to the ink jet recording apparatus.

DETAILED DESCRIPTION OF THE PREFERRED EMBODIMENTS

Hereinafter, with reference to the accompanying drawings, the description will be made of the embodiments in accordance with the present invention.

First Embodiment

Figure 1:
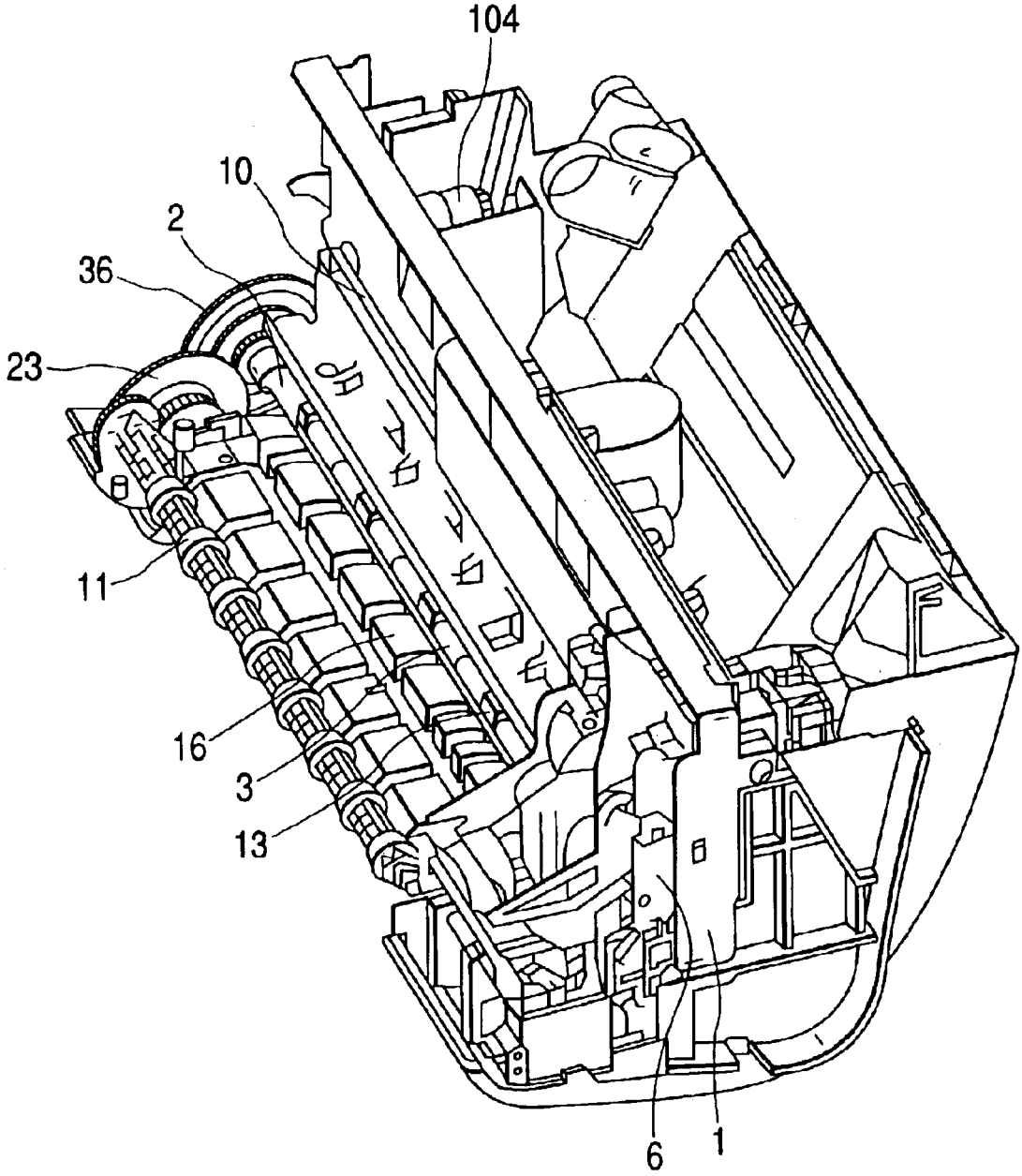
FIG. 1 is a perspective view that shows the assembly of the recording unit and the base unit of an ink jet recording apparatus in accordance with a first embodiment of the present invention.
Figure 2:
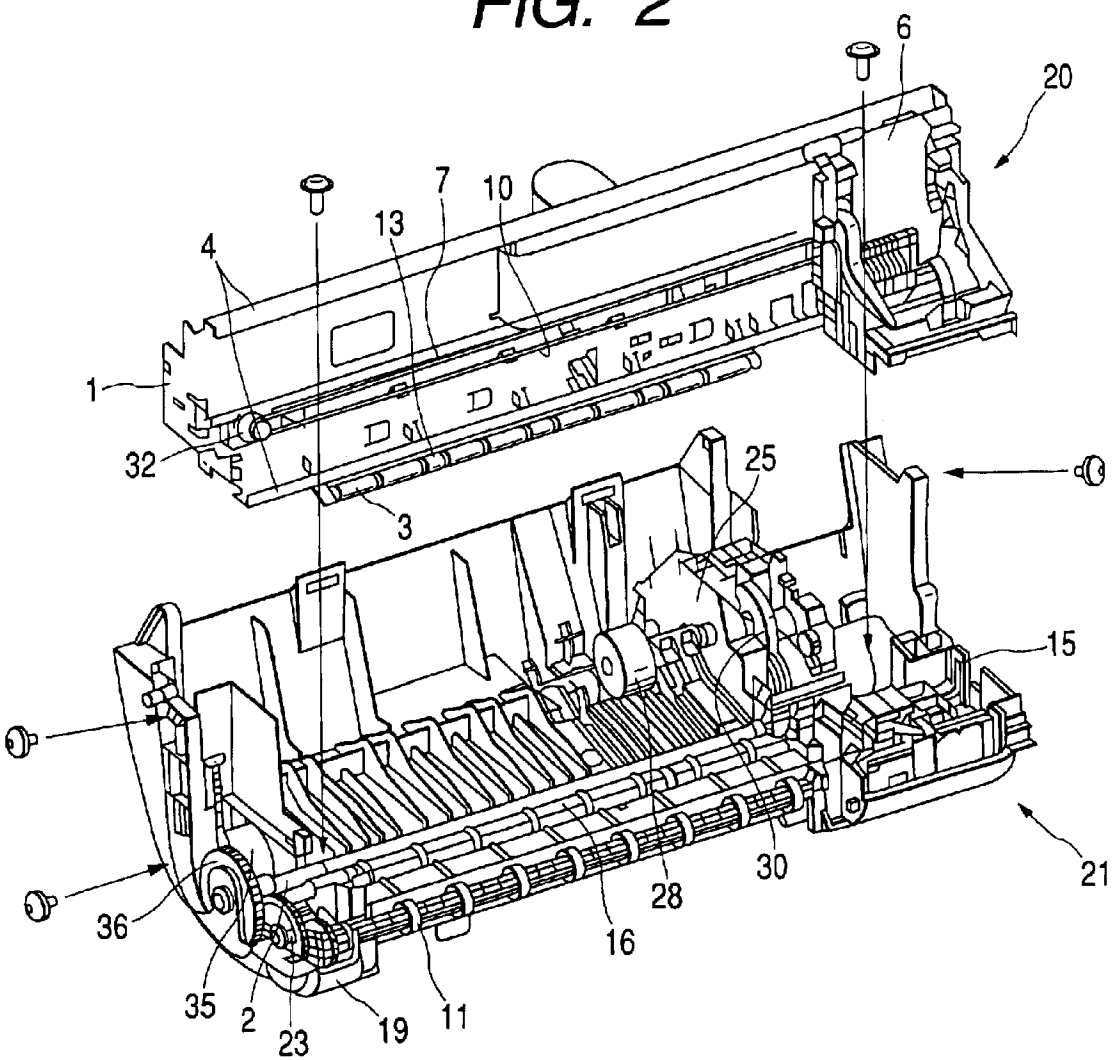
FIG. 2 is an exploded perspective view that shows the assembled body represented in FIG. 1.
Figure 3:
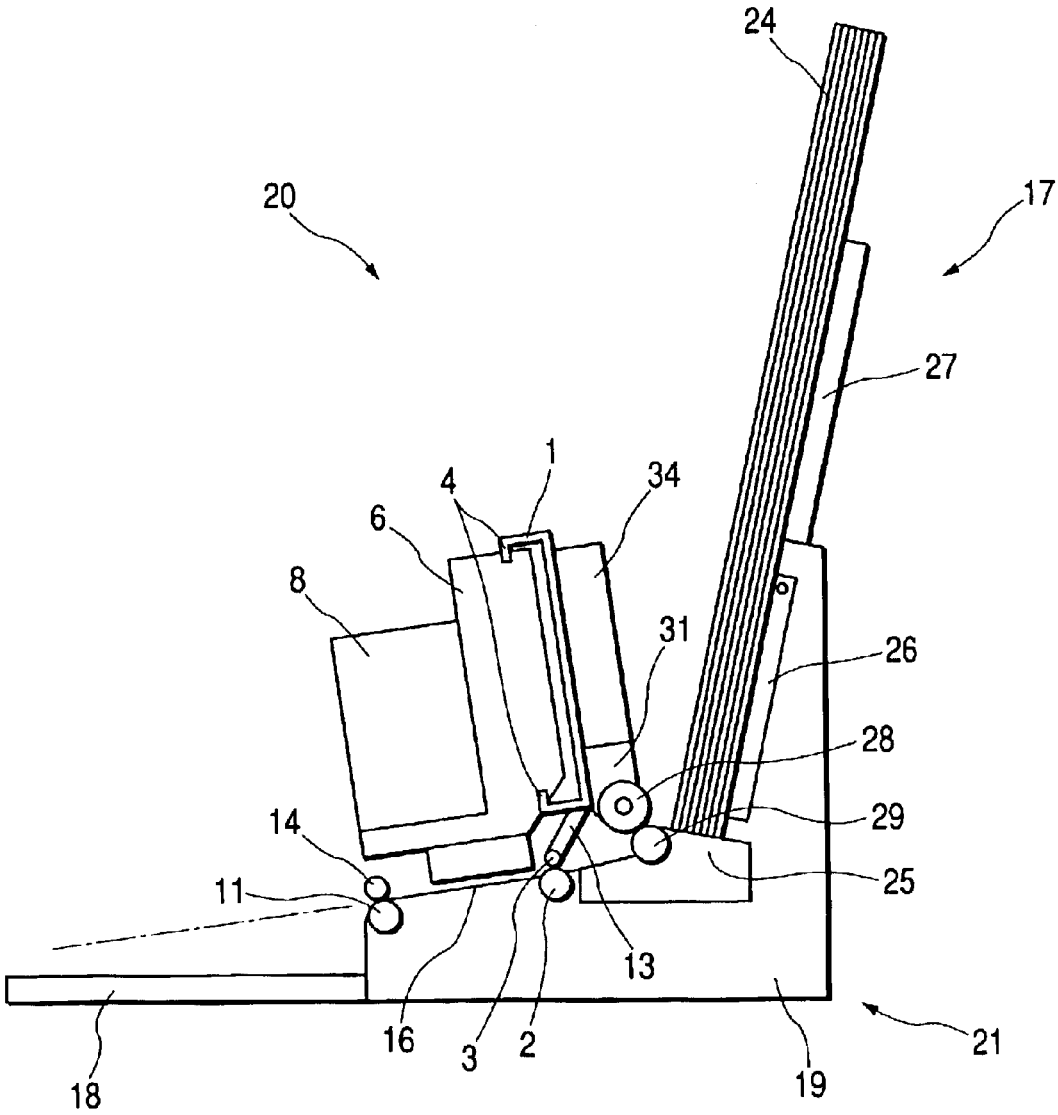
FIG. 3 is a side view that schematically shows the structure of the ink jet recording apparatus in accordance with the first embodiment of the present invention.
Figure 4:
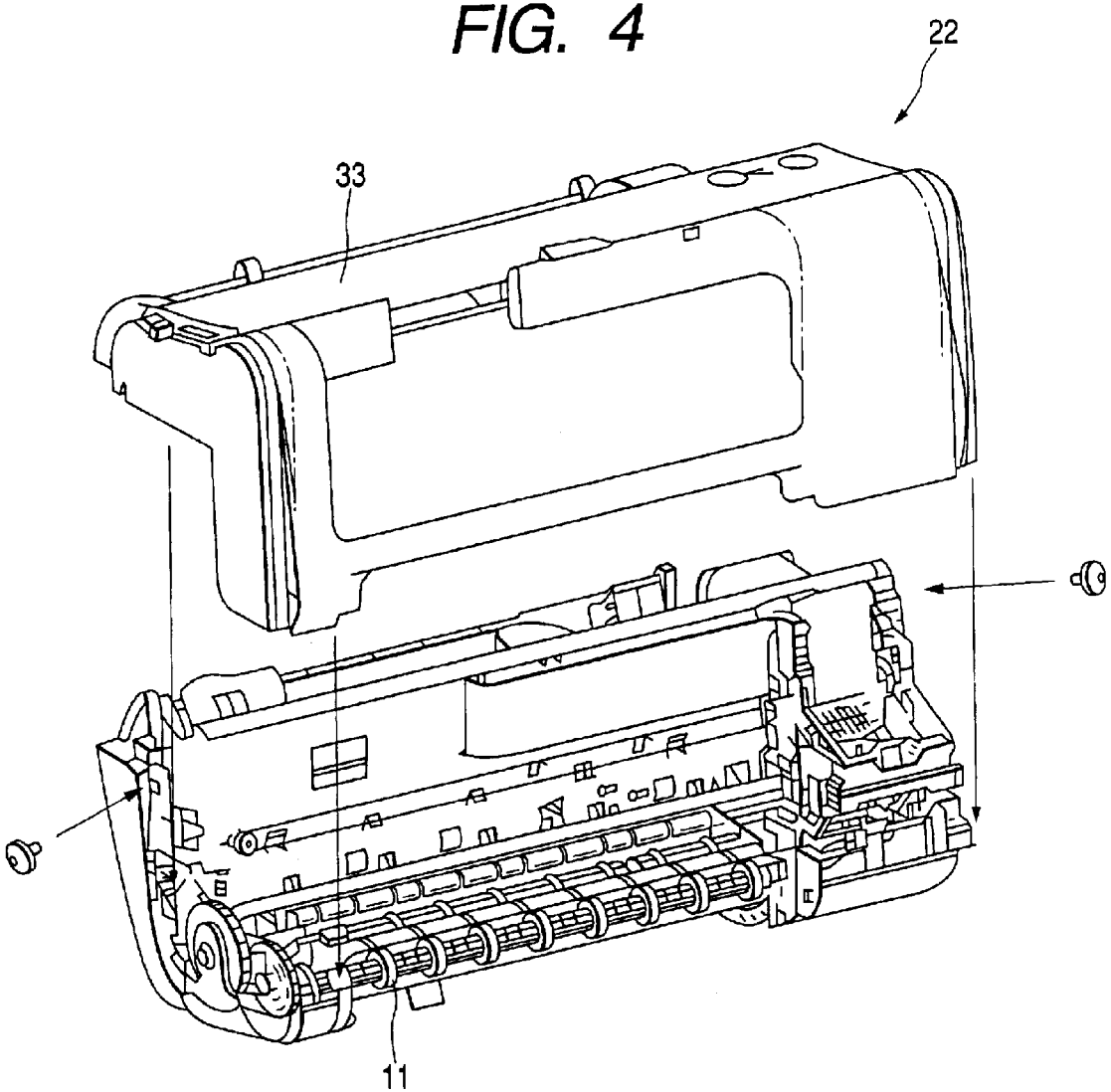
FIG. 4 is an exploded perspective view that shows the assembled body represented in FIG. 1 and a main case unit.

FIGS. 1 to 4 are views that schematically illustrate an ink jet recording apparatus in accordance with a first embodiment of the present invention. This ink jet recording apparatus is structured mainly with a recording unit 20, a base unit 21, and a main case unit 22. These are fixed to each other by means of screws or the like. FIG. 1 is a perspective view that shows the assembly of the recording unit 20 and the base unit 21. FIG. 2 is an exploded perspective view thereof. FIG. 3 is a side view that schematically shows the structure of the apparatus as a whole. FIG. 4 is an exploded perspective view that shows the assembled body of the recording unit 20 and the base unit 21, and the main case unit 22. Here, for convenience's sake, the description will be made with the assumption that the side having a sheet-expeller tray 18 is provided for the apparatus is in the front in the description given below.

As shown in FIG. 2, the recording unit 20 is formed by a plate member, which is provided with a rear wall arranged to stand in the vertical direction. The upper end, lower end, and right-hand end of the rear wall are folded toward the front to form the upper-end folded portion 1*a*, the lower-end folded portion 1*b*, and the right-hand-end folded portion 1*c*, thus presenting a chassis 1 having almost a box-type configuration as a whole. The folded portions on the upper and lower ends of the chassis 1 form a guide portion 4 of a carriage 6. In other words, the carriage 6 is provided with the connecting portions that engage with the guide portion 4 on the upper end portion and lower end portion thereof. Then, in a state of being connected, the carriage is slidably supported in the left and right directions. The carriage 6 is installed on the chassis 1 from the left-hand end where no folding portion is provided.

There is connected with the carriage 6, a ring type driving belt 10, which is tensioned around both pulleys 40 rotatively each supported respectively on the left and right end portions on the front part of the rear wall of the chassis 1. For the pulleys 40 and the driving belt 10, teeth are arranged to engage with each other. To the pulley on the right side, biasing force is given toward the right-hand side so that the driving belt 10 is provide with a predetermined tensioning force exerted by this biasing force. With the pulley 40 on the left side, the carriage motor 104 (see FIG. 1) is connected. Thus, when the carriage motor 104 is driven, the carriage 6 reciprocates with the driving force applied thereto through the pulley and driving belt 10.

Also, on the left side of the left-hand side pulley 40, belt stoppers 32, which surround the outer circumferential surface of the pulley 40, are arranged to extrude forwardly from the chassis 1 at predetermined intervals. With the belt stopper 32, it is made possible to avoid the floating of the driving belt 10 from the outer circumferential surface of the pulley so as to prevent the driving belt from skipping over the teeth thereof when any over-load or the like should take place unexpectedly. The belt stoppers 32 are structured to abut against a part of the carriage 6 when the carriage 6 moves to the left side too much. Therefore, the belt stoppers 32 also function as a stopper to prevent the carriage 6 from moving beyond a regulated range of the normal main scan even if the carriage 6 should be caused to over run.

Figure 5:
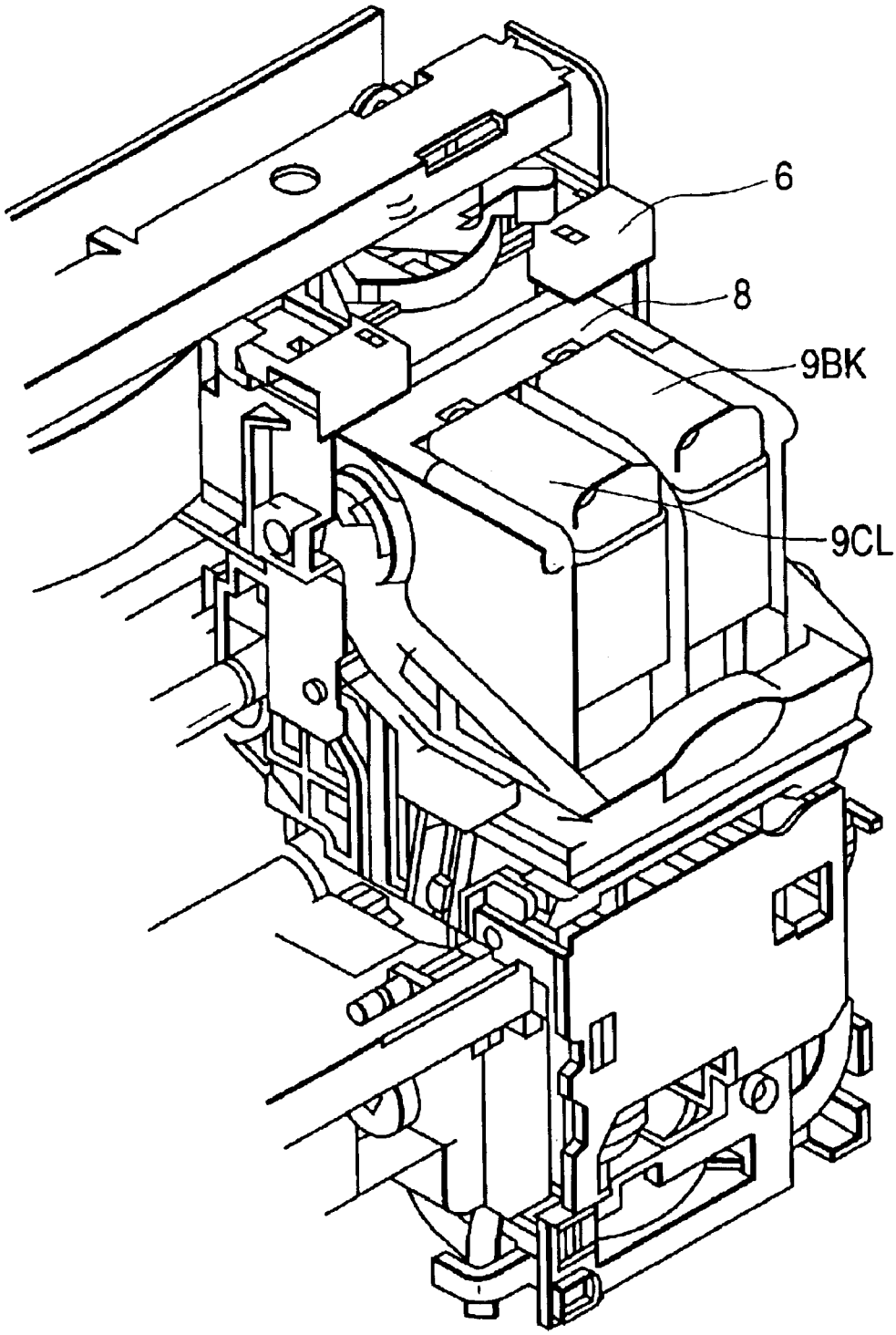
FIG. 5 is a perspective view that shows the carriage in the assembled body represented in FIG. 1, and the recording head and ink tank portion mountable on the carriage.

As shown in FIG. 5, the recording head 8 is mountable on the carriage 6. In accordance with the present embodiment, the recording head 8, although not shown in detail, is an ink jet recording head that discharges liquid, such as ink, by the utilization of thermal energy. The recording head 8 is provided with plural electrothermal converting members serving as the element that generates thermal energy; and plural nozzles communicated through over the electrothermal converting members with plural discharge ports, which are open downward. The recording head 8 discharges liquid form discharge ports utilizing pressure changes to be made by the generation, growth, and shrinkage of bubble when film boiling is given to liquid by the application of thermal energy.

For the present embodiment, the home position (HP) of the carriage 6 is located on the right end, and the conveying path of the recording medium 24 on the left side thereof is the recording area, which will be described later. On the recording head 8, there are mounted an ink tank 9BK that retains black (BK) ink, and an ink tank 9CL that retains ink of each color (CL), more specifically, ink of cyan, magenta, and yellow, respectively, in that order further away from the recording area when the recording head is in the HP status. Then, correspondingly, the plural ink supply ports for supplying ink for each color from the ink tanks, which retains ink of each color, and the plural nozzle arrays for discharging ink of each color thus supplied, are arranged for the recording head 8 in the order of BK use and CL use from the side further away from the recording area in the HP status, although not shown.

For the recording head 8, a connector and wiring are provided for each of the electrothermal converting members, and the connector is connected with the carriage 6 to make the electrical connection with the recording apparatus main body. For the carriage 6, there is arranged on the backside thereof, the base plate 34 (see FIG. 3) having a circuit incorporated thereon, which is connected with the recording head 8, and also, connected with the recording apparatus main body side through a flexible cable 41 in order to control the operation of the recording head 8.

On the front face of the rear wall of the chassis 1, an encoder 7 is arranged. With this encoder 7 and a sensor (not shown) provided for the base plate on the carriage, the position of the carriage 6 is detected. The positional signal of the carriage 6 thus detected is utilized for controlling the operations of the carriage 6 and the recording head 8. The encoder 7 is positioned in a state of being biased on a predetermined location in good precision. For this example, in particular, the encoder is arranged in a state of being biased toward the left-hand side.

On the lower end of the chassis 1, the pinch roller holder 13, which axially supports the pinch roller 3 rotatively at one end, is axially and rotatively supported at the other end. The pinch roller holder 13 is rotatively biased so as to enable the pinch roller 3 to be directed downward.

The base unit 21 is provided with a base 19 (see FIG. 3) having on the lower end thereof the supporting face for the installation of the ink jet recording apparatus. On the rear end of the base 19, the base unit 21 is positioned and arranged. For the base unit 21, the pressure plate 26 and the sheet-feeding tray 27 are arranged to stand diagonally backward. Plural sheets of recording medium 24 are stacked on them. The pressure plate 26 is fixed to the ASF base 25 so as to make the upper end portion of the pressure plate 26 rotative, and the lower end portion thereof rotatively biased by a spring (not shown) in the forward direction (in clockwise direction in FIG. 3).

On the position at which the lower edge portion of the stacked recording medium 24 pressed by the pressure plate 26 thus rotatively biased, the sheet-feeding roller 28 is arranged. The sheet-feeding roller 28 is axially supported on one end by a sheet-feeding roller bearing 31 provided for the chassis 1, and axially supported on the other end by the ASF base 25. On the end portion of the sheet-feeding roller 28 on the side where it is supported by the ASF base 25, a sheet-feeding roller gear 30 is fixed (see FIG. 2). Although not described in detail, the sheet-feeding roller gear 30 is connected with the rotational shaft of the carrier roller 2 to be described later through other gears and the like. Therefore, this roller is driven to rotate by use of the LF motor 35 that drives the carrier roller 2. At the position facing the sheet-feeding roller 28, the separation roller 29 is arranged. The separation roller 29 is biased to the sheet-feeding roller 28 with biasing means (not shown).

The sheet-feeding roller 28 is driven to rotate when the recording operation begins, and feeds a recording medium 24. The pressure plate 26 is interlocked with the sheet-feeding roller 28 by means of a control cam (not shown) axially supported by the ASF base 25. In this way, the pressure plate 26 presses the recording medium 24 to the sheet-feeding roller 28 by means of the aforesaid biasing force at the time of feeding, and on standby, the lower end portion thereof is pushed backward against such biasing force. On standby, therefore, the recording medium 24 can be stacked on and also, removed from the pressure plate 26 freely. The recording medium 24 thus stacked is retained in a state where the lower end thereof abuts against the rib arranged for the ASF base 25.

When the sheet-feeding is executed, the separation roller 29 functions so as not to allow the recording medium 24 on the separation roller side to advance any further if plural sheet of recording medium 24 are inserted into a nip between the sheet-feeding roller 28 and the separation roller 29. Therefore, the recording medium 24 is separated one by one for feeding. The automatic sheet-feeding unit 17 is formed with the pressure plate 26, the sheet-feeding roller 28, the separation roller 29, and others.

On the position at which the leading edge of the recording medium 24 thus fed by the automatic sheet-feeding unit 17 arrives, the carrier roller 2 is arranged. To the carrier roller 2, there is pressed the pinch roller 3 fixed to the lower end of the chassis 1 by means of the aforesaid biasing force. The leading edge of the recording medium 24 thus fed is pinched in a nip between the carrier roller 2 and the pinch roller 3. The carrier roller 2 is rotatively supported to the base 19, and one of the end portions thereof, the LF gear 36 is fixed. It is driven to rotate by the LF motor 35 through this LF gear 36.

Beneath the passage to convey the recording medium 24 with the rotation of the carrier roller 28, there is provided above the carriage 6, which is arranged to reciprocate, the platen 16 in a position facing the discharge port formation surface of the recording head 8. In front of the platen 16, the sheet-expeller roller 11, which is axially supported by the base 19, is arranged to be rotative. Here, as shown in FIG. 4, the main case unit 22 axially supports the spur 14, which is arranged to face the sheet-expeller roller 11.

The sheet-expeller roller 11 is connected with the rotational shaft of the carrier roller 2 through the idle gear 23, which is axially supported by the base 19 to rotate, and interlocked with the carrier roller 2, the sheet-expeller roller is driven to rotate. The recording medium 24, which is bid in a nip between the sheet-expeller roller 11 and the spur 14, is expelled by the rotation of the sheet-expeller roller 11. Then, the sheet-expeller tray 18 is fixed to the base 19 in the front part of the ink jet recording apparatus where the recording medium 24 is expelled in such a manner.

In accordance with the present embodiment, the passage, in which the recording medium 24 is conveyed from the nip between the carrier roller 2 and the pinch roller 3 to the nip between the sheet-expeller roller 11 and the spur 14 by way of the platen 16, is inclined slightly forward to the bottom face of the base 19, that is, to the installation face of the ink jet recording apparatus as shown in FIG. 3. This inclination of the passage of conveyance is set at 10 degrees. In agreement therewith, the recording unit 20 is also arranged to be inclined slightly, particularly at 10 degrees. Thus, the discharge port formation surface of the recording head 8 is made to be in parallel to the recording surface of the recording medium 24 to be conveyed on the platen 16.

Figure 6:
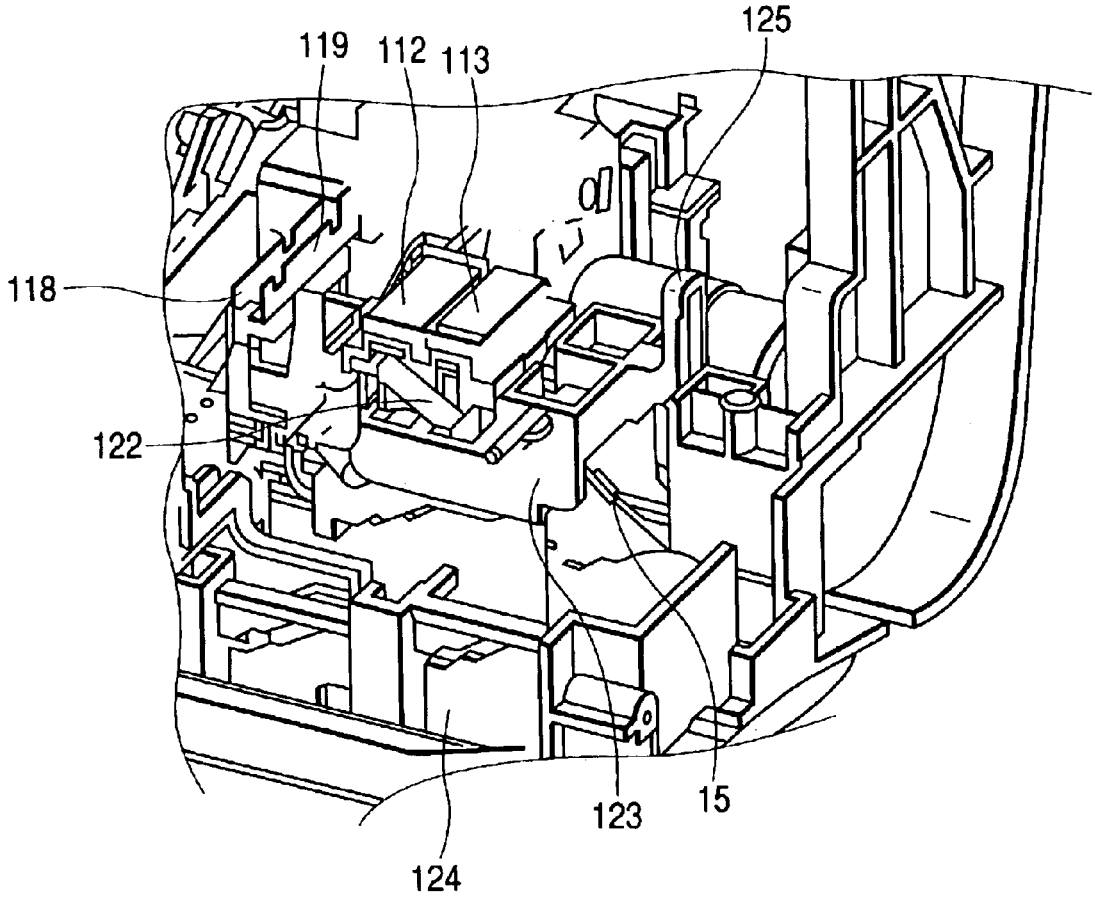
FIG. 6 is a perspective view that shows the suction recovery means, which is mounted on the base unit of the ink jet recording apparatus in accordance with the first embodiment of the present invention.

For the base unit 21, there is further arranged, suction recovery means 15 (see FIG. 2) in a location below the carriage 6 when the carriage 6 is in the home position. FIG. 6 is an enlarged view that shows this portion of the suction recovery means 15.

As shown in FIG. 6, the suction recovery means 15 is provided with the cap slider 123 to which is fixed the cap holder 122 that retains caps 112 and 113 in a state of being open upward. Also, to the cap slider 123, blades 118 and 119 are fixed so as to stand upward. The cap slider 123 is biased downward, and also, toward the left side by biasing means, such as spring (not shown), so as to abut against the four ribs 124, which are raised by four steps toward the right side. On the right-hand end of the cap slider 123, there is arranged the abutting rib 125, which extends upward to the position where it abuts against a part of the carriage 6 traveling to the home position.

Therefore, when the carriage 6 moves to the right towards the home position, the cap slider 123 is caused to move to the right-hand side. At this juncture, the cap slider 123 slides along the upper edge of the rib 124. On other words, the rib 124 functions as a cam, and the slider moves upwards. Along with this movement of the carriage 6, the blades 118 and 119 abut against. The discharge port formation surface of the recording head 8. Then, the blades are allowed to slide, thus performing the wiping operation.

Of the blades 118 and 119, the blade 118 on the left side is for use of color ink, and the blae 119 on the right side is for use of black ink. In other words, each of the blades 118 and 119 is positioned and fixed to the cap slider 123 so that along with the movement of the cap slider 123, each of them can wiper on the circumference of the discharge port arrays of the recording head 8 for use of black ink and that of those for use of color ink. In this way, each of the blades 118 and 119 is arranged to abut the discharge port formation surface of the recording head 8 in the designated amount of advancement, the designated angle and pressure of contact for each of them.

Also, when the carriage 6 moves to the home position, the caps 112 and 113 are allowed to move to the position where the caps can cover the discharge port formation surface of the recording head 8. The cap holder 122 is then supported to the cap slider 123 to be rotative within a designated range so that the caps 112 and 113 are to be air tightly in contact with the discharge port formation surface in good condition, and also, it is biased upward by a cap spring (not shown). Of the caps 112 and 113, the cap 112 on the left side is for use of color ink, and the cap 113 on the right side is for use of black ink.

Figure 7:
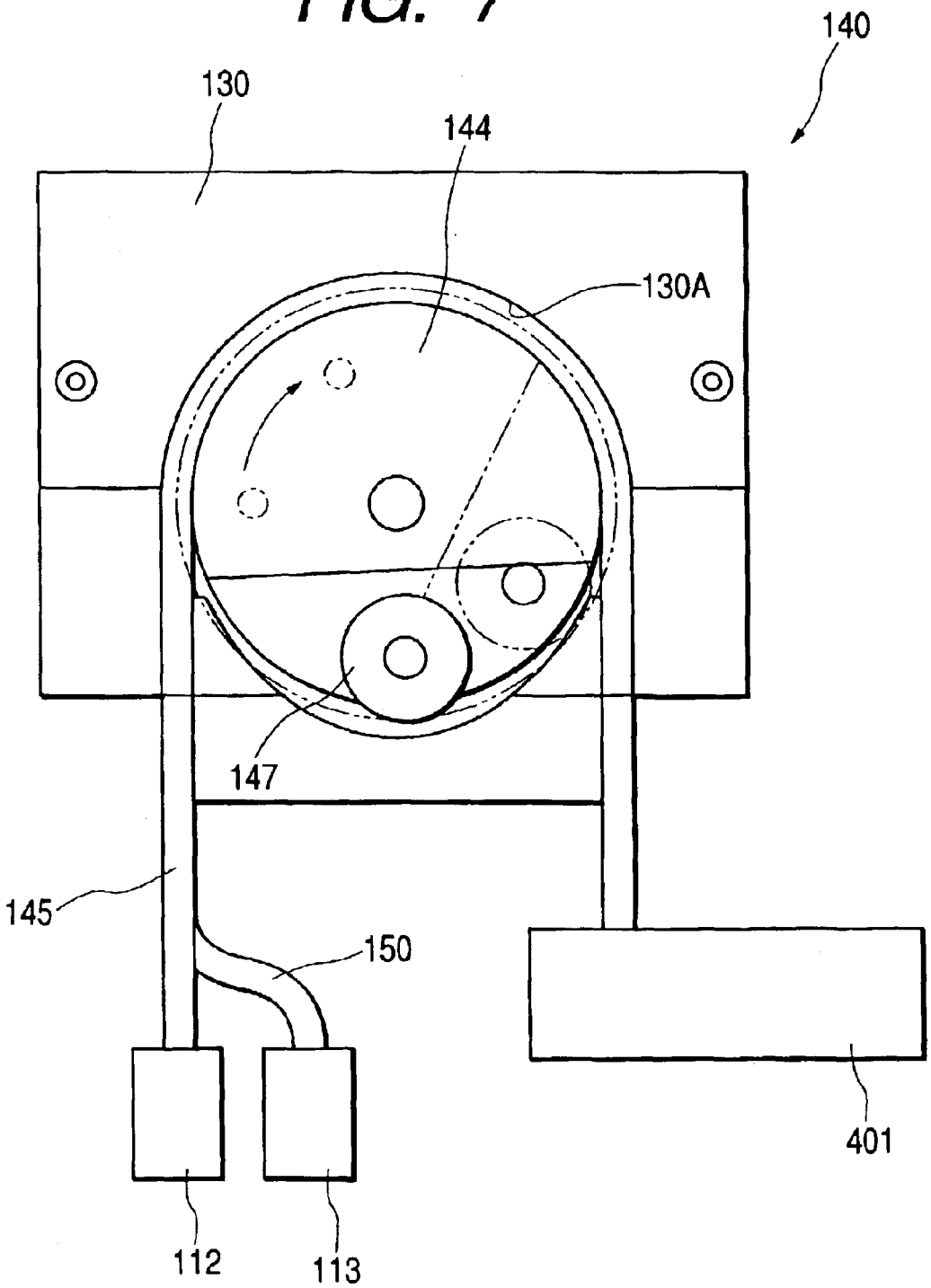
FIG. 7 is a view that schematically shows the structure of negative pressure generating means provided for the suction recovery means represented in FIG. 6.

To the caps 112 and 113, negative pressure generating means is connected. FIG. 7 is a view that schematically shows the structure of a pump unit 140 that forms negative pressure generating means. The pump unit 140 is the so-called tube pump, and to each of the caps 112 and 113, the suction tubes 145 (color ink use) and 150 (black ink use) are connected extendedly through the cap holder 122, respectively.

The pump unit 140 is provided with the roller holder 144 in a groove having semi-cylindrical bottom face, which is formed for the recovery system base 130 to become a pressurized guide 130A, and which is axially supported to be rotative coaxially with the bottom surface. The roller holder 144 has a column type outer circumference, which is positioned with a designated gap to the pressurized guide 130A. Thus, the suction tubes 145 and 150 are guided through this gap. The end portion of the suction tubes 145 and 150 on the side opposite to the one where tubes are connected with the caps 112 and 113 is connected with the waste ink absorbent 401, which is arranged in the base 19.

To the roller holder 144, a column type roller 147 is axially supported with the outer circumference of this roller being extruded from the outer circumference of the roller holder 144. The roller holder 144 is connected with the LF motor 35 through gears (not shown) to be driven to rotate in clockwise direction as required as indicated by an arrow in FIG. 7. When the roller holder 144 rotates like this, the suction tubes 145 and 150 are pressed and squeezed by means of the roller 147. At this juncture, the locations of the suction tubes 145 and 150, which are squeezed, are caused to move from the portion on the caps 112 and 113 sides to the sides away from that portion along with the rotation of the roller holder 144. When the suction tubes 145 and 150 are squeezed in such a manner, negative pressure is exerted in each of the caps 112 and 113.

The main case unit 22 (see FIG. 4) is provided with the main case 33 to cover the upper part and side part of the assembled body of the recording unit 20 and the base unit 21, which have been described above. To the main case 33, the spur 14 is axially supported in the position that faces the sheet-expeller roller 11 in condition that the main case 33 is fixed as described earlier. The spur 14 is biased to the sheet-expeller roller 11 with biasing means, such as a spring, (not shown).

The ink jet recording apparatus of the present embodiment is connected with a host computer for use, for example, and executes recording operation when receiving recording instructions or image data from the hose computer. With the reception of recording instructions, the stacked recording medium 24 is separated and fed by the automatic sheet-feeding unit 17 one by one for feeding. The recording medium 24 thus fed is conveyed to a designated recording position by use of the carrier roller 2. After that, the carriage 6 reciprocates. At this juncture, the recording head 8 is driven in accordance with image data to discharge ink selectively from the discharge ports for recording images on the strip area on the recording medium 24 corresponding to the image data thus received. Then, by use of the carrier roller 2, the recording medium 24 is conveyed in a designated amount corresponding to the recording width. After that, the recording head 8 again executes recording in the area that has shifted from the previous one. In this way, the recording of a designated width and the conveyance of a designated width are repeated to record a desired image on a desired area.

When recording operation is at rest, the carriage 6 moves to the home position. Then, with the blades 118 and 119, the discharge port formation surface of the recording head 8 is wiped to remove adhering ink, dust particles, and others. Also, the caps 112 and 113 cover each of the discharge ports, thus suppressing the evaporation of ink from the discharge ports and the increase of viscosity thereof as well. In a state of the discharge ports being capped like this, the pump unit 140 is driven as required. Then, ink is sucked from nozzles to remove overly viscous ink, bubbles, and dust particles remaining inside altogether. Thus, ink is refilled in the nozzles in good condition. In this way, it becomes possible to prevent nozzles from being clogged with dust particles and overly viscous ink, and ink discharges from being made difficult. Ink tus sucked out is discarded into the waste ink absorbent 401. With the appropriate execution of wiping, capping, and suction recovery, it is possible to maintain the discharge of liquid from the recording head 8 in high precision.

As described above, for the ink jet recording apparatus of the present embodiment, the base 19 supports the carrier roller 2 and the sheet-expeller roller 11, and on the other hand, the chassis 1 supports the carriage 6 slidably, and also, supports the pinch roller holder 13 axially. Also, one end of the sheet-feeding roller 28 is supported with the chassis 1, and the other end thereof is supported with the base 19 axially. Therefore, as compared with the conventional art whereby to from the structure for supporting all of them with one chassis, the structure of the present embodiment makes it possible to reduce the load that may be given to the chassis 1 and the base 19. Also, the chassis 1 is made in the form of a box as a whole by folding the upper and lower end portions, and the right-hand end of the plate member. As a result, the structure is simple and inexpensive, yet having comparatively high strength and rigidity.

For the reasons described above, the structure of the present embodiment makes it possible to support and operate the carriage 6 and the pinch roller 13 in good precision without displacing them from the designated positions even if a comparatively thin material is used for the chassis 1. Particularly, in accordance with the present embodiment, a member, the plate thickness of which is 0.8 mm, is adoptable for the chassis 1, for example. Also, since the carriage 6 is slidably supported with the portions formed by folding the upper and lower edges of the chassis 1, the guide shaft, which is required for the conventional art, is no longer needed, thus making it possible to attempt simplifying the structure of the apparatus by reducing the part numbers.

Also, a load given to the base 19 is comparatively small as compared with the conventional example, and further, the base is reinforced by the engagement with the chassis 1, which has a higher strength. As a result, even if an inexpensive material, the strength of which is not very high, is used for the formation of the base, it is possible to support and operate the carrier roller 2, the sheet-expeller roller 11, and others in high precision without displacing them from the designated positions. Here, the base 19 may be structured by use of resin mold material in particular.

As has been described above, the structure of the present embodiment does not produce any adverse effect on the images recorded on a recording medium 24. Therefore, while maintaining, a high-quality image formation, it is possible for the structure to adopt a simpler, and more inexpensive supporting members than those of the conventional example. Moreover, it is possible to attempt making the structure of the apparatus simpler. Thus, in accordance with the present embodiment, it is possible to reduce the manufacturing costs of an ink jet recording apparatus significantly, as well as to attempt downsizing the apparatus.

Second Embodiment

Figure 8:
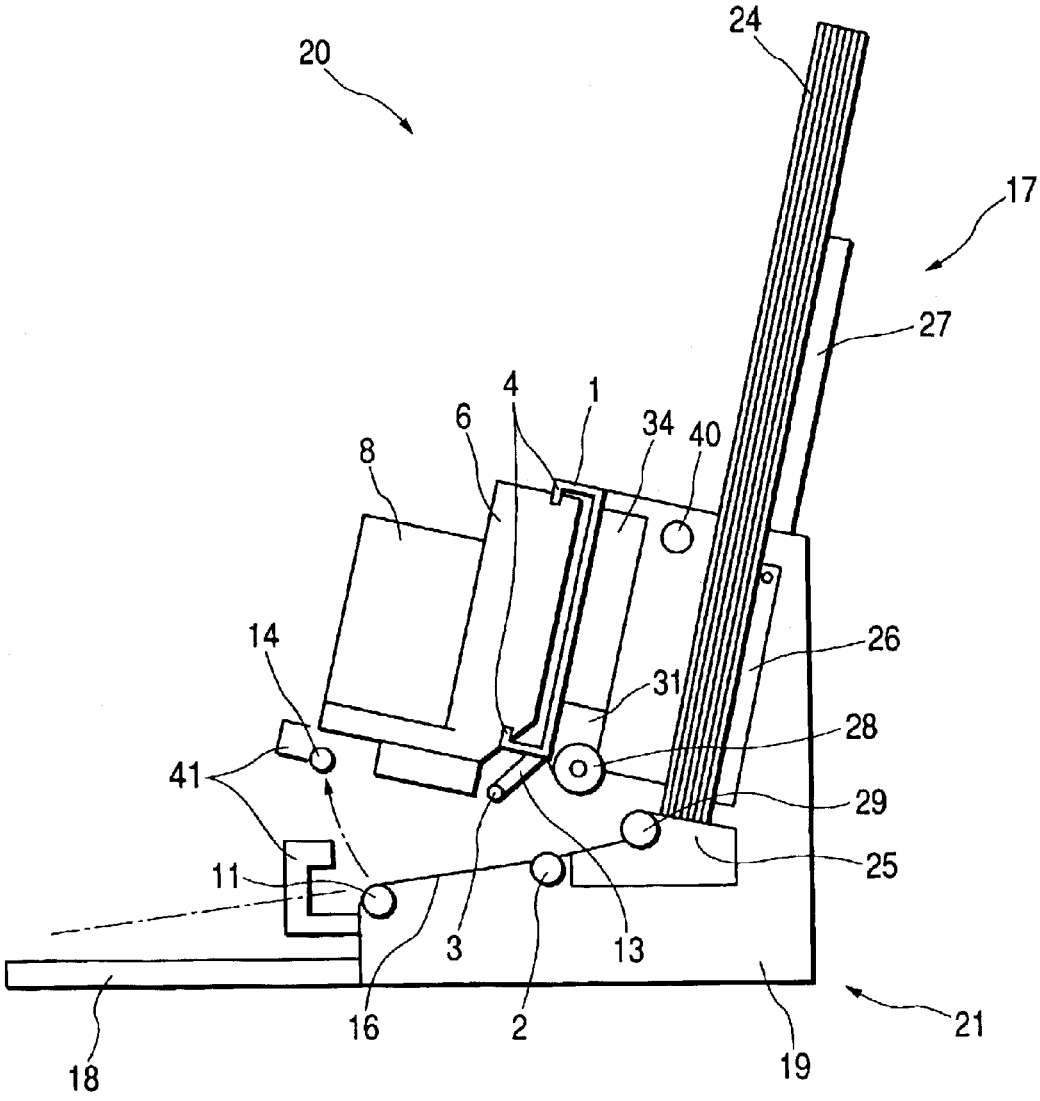
FIG. 8 is a side view that schematically shows the structure of an ink jet recording apparatus in accordance with a second embodiment of the present invention.
Figure 9:
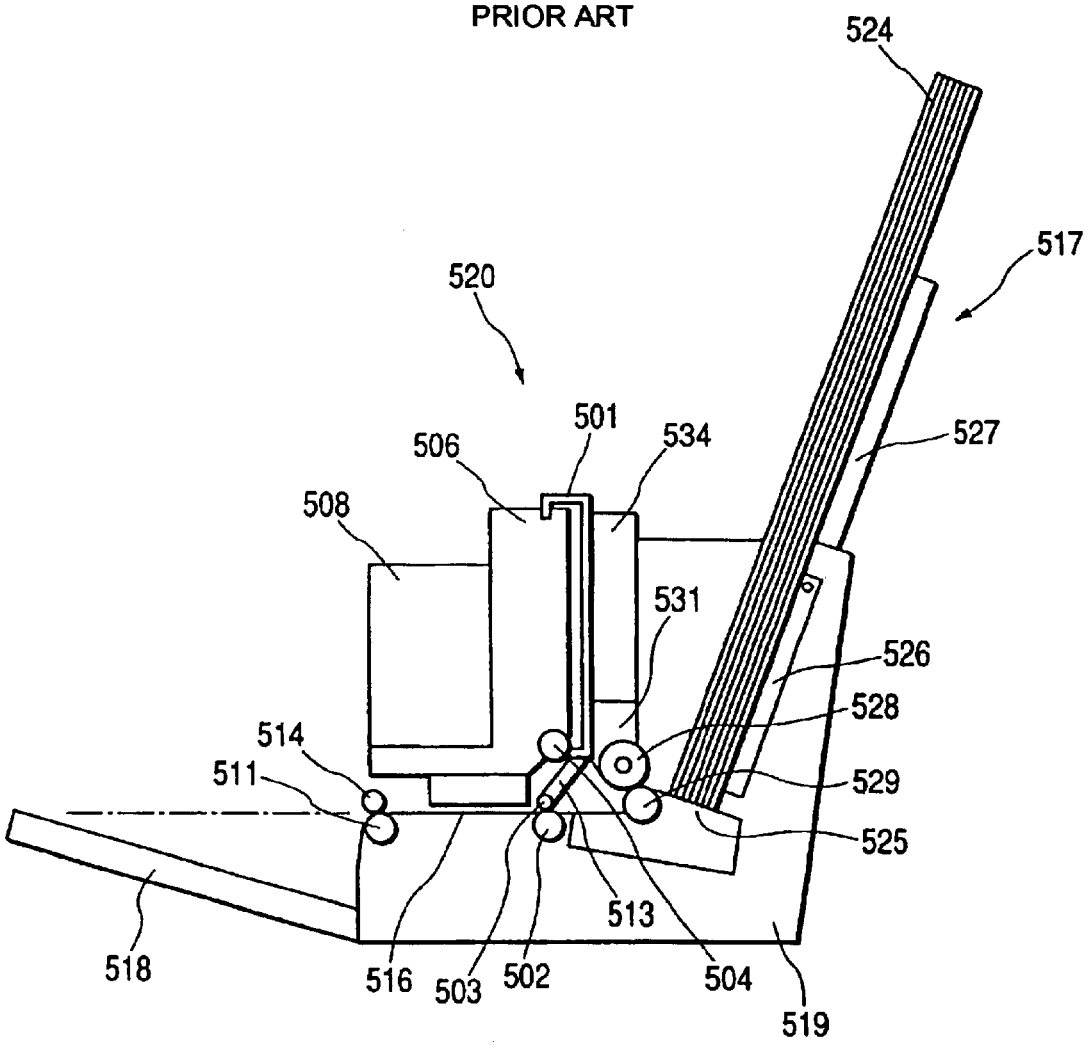
FIG. 9 PRIOR ART
FIG. 9 is a side view that schematically shows the structure of the conventional ink jet recording apparatus.
Figure 10:
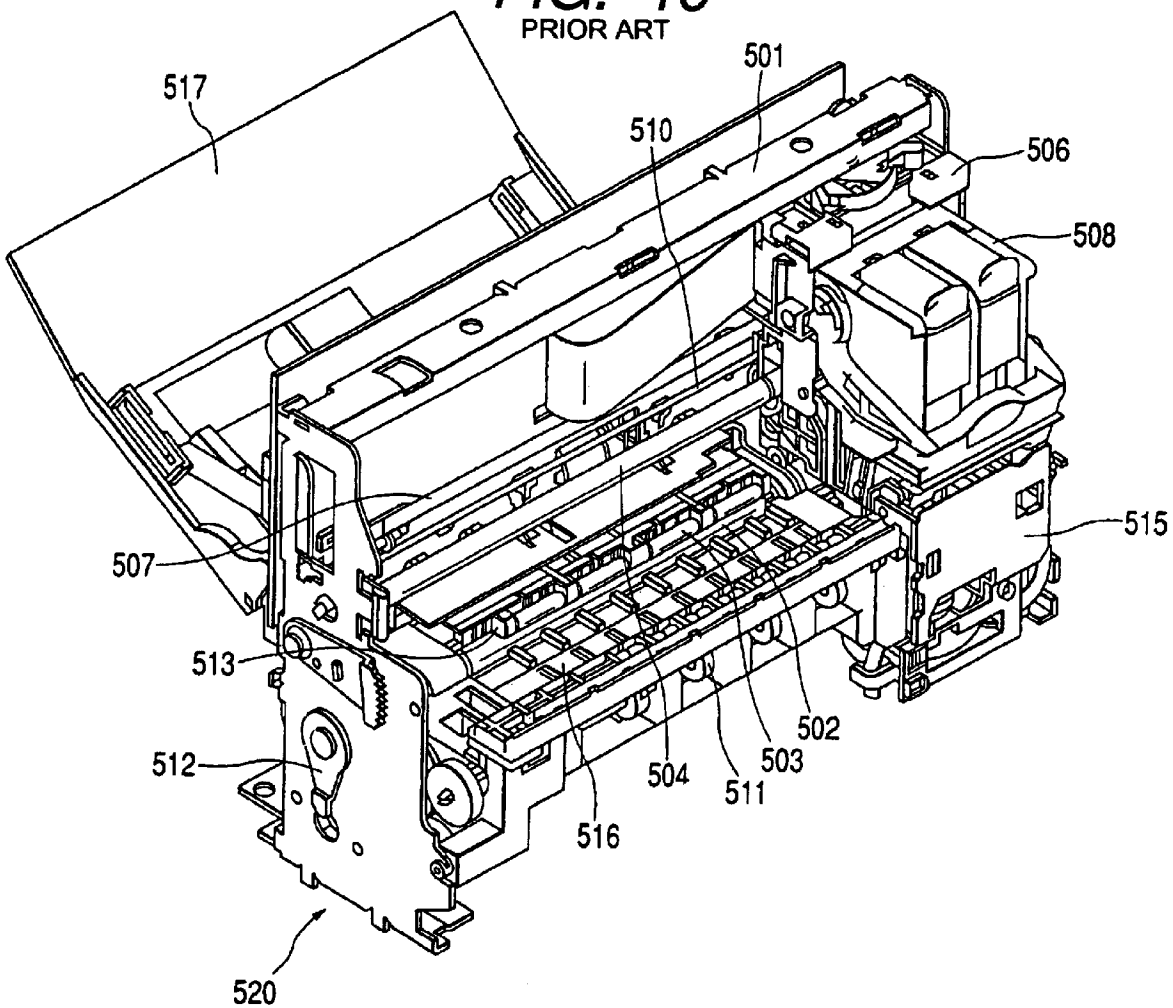
FIG. 10 PRIOR ART
FIG. 10 is a perspective view that shows the printer unit of the conventional ink jet recording apparatus.

FIG. 8 is a side view that schematically shows the structure of an ink jet recording apparatus in accordance with a second embodiment of the present invention. In FIG. 8, the same reference marks are applied to the same parts as those appearing in the first embodiment, and the description thereof will be omitted.

For the present embodiment, a recording unit 20 is axially supported and fixed to a base 19 so as to rotate within a designated area around a connecting shaft 40 installed on the rear upper end of the recording unit 20. For the front-end portion of the base 19 and the recording unit 20, there is arranged the fixing member 41, which enables them to engage with each other. The recording unit 20 is arranged for the base unit 21 in the relative positions as in the case of the first embodiment (see FIG. 3) when both of them engage with each other by use of the fixing member 41. In other words, In a state of the fixing member 41 being connected, the pinch roller 3, which is provided for the recording unit 20 is allowed to abut against the carrier roller 2, which is provided for the base unit 21, and then, the discharge port formation surface of the recording head 8, which is mounted on the carriage 6 for reciprocation, is placed in the position on a plane in parallel to the platen 19.

With the structure of the present embodiment, too, each of the structural parts are separated into the chassis 1 and the base 19 for support, and also, the chassis 1 is arranged in the form of a box having a high strength, thus making it possible to structure the chassis 1 with a comparatively thin material, while securing a sufficient strength. Moreover, since the chassis 1 functions and reinforces the base 19, it becomes possible to structure the base 19 with a comparatively low-strength material, with a resin mold material, in particular.

Also, the structure of the present embodiment enables the recording unit 20 to rotate by releasing the engagement of the fixing member 41, thus making it possible to open the passage in which a recording medium 24 is conveyed. Therefore, should paper jamming or the like occurs in the conveying passage of the recording medium 24, it is easier to execute such process as to remove the jammed recording medium 24, among some others.

As described above, in accordance with the present invention, the carriage, the carrier roller, the pinch roller, the sheet-expeller roller, and others are allotted to the recording unit and the base unit for support, respectively, thus making it possible to reduce the respective loads given to each supporting member. Further, the upper and lower edge portions of a plate member are folded to make a chassis in the form of box, which is used as the supporting member of the recording unit. In this way, the strength thereof can be made comparatively high, despite the structure is structured simply at lower costs. Then, with this chassis being connected with a base unit, it becomes possible to reinforce the base unit.

Therefore, in accordance with the present invention, it is possible to provide a recording apparatus, an ink jet recording apparatus, in particular, capable of recording images in high quality by supporting and operating each member in good precision with the comparatively simple and inexpensive structure, but having comparatively high strength.

What is claimed is:

1. A recording apparatus for recording an image on a recording medium by a recording head, comprising:

an assembled body having a base unit and a recording unit fixable to each other, wherein said recording unit is provided with a chassis made in the form of a box as a whole by folding upper and lower edge portions of a plate member, and also, by folding at least one of said ends thereof;

a carrier roller rotatively and axially supported by said base unit and driven to rotate for pinching and conveying a recording medium;

a pinch roller rotatively and axially supported by said chassis to face said carrier roller; and a carriage supported by said chassis above said recording medium, said carriage for mounting the recording head and being reciprocable in a direction intersecting a conveying direction of said recording medium, wherein conveyance of said recording medium is repeated by a designated amount, and the recording of images is effected in an area of a designated width on said recording medium by the recording head.

2. A recording apparatus according to claim 1, further comprising:

a sheet-feeding tray enabling said recording medium to be stacked thereon; and a sheet-feeding roller for feeding one of said recording medium stacked on said sheet-feeding tray one by one to a nip between said carrier roller and said pinch roller, wherein one end of said sheet-feeding roller is axially supported by said recording unit, and the other end thereof is axially supported by said base unit.

3. A recording apparatus according to claim 1, wherein said carriage is slidably supported to reciprocate with the folded parts of the upper and lower edge portions of said chassis serving as a guiding portion therefor.

4. A recording apparatus according to claim 1, wherein said base unit is provided with a base formed by resin mold material, and axially supports said carrier roller to said base.

5. A recording apparatus according to claim 1, wherein said recording unit and said base unit are connected with a connecting shaft to enable them to rotate relatively around said connecting shaft to a position having said carrier roller and said pinch roller arranged to face each other, and to a position of said carrier roller and said pinch roller being apart from each other.

6. A recording apparatus according to claim 1, wherein said chassis further supports a ring type driving belt connected with said carriage; plural pulleys having said driving belt being tensioned round them; biasing means for biasing at lest one of said pulleys in the direction to given tension to said driving belt; and a driving motor connected with one of said pulleys, and said chassis is provided with the wall face positioned with a designated gap to the outer circumferential surface of said pulley connected with said driving motor for at least a part of the portion having said driving belt tensioned, and a belt stopper is formed to abut against a part of said carriage when said carriage moves beyond a designated area in the sliding direction thereof.

7. A recording apparatus according to either one of claim 1 to claim 6, wherein an ink jet recording head for discharge liquid is mounted as said recording head.

8. A recording apparatus for recording an image on a recording medium by a recording head, comprising:

a carrier roller driven to rotate for conveying a recording medium;

a pinch roller rotatively and axially supported to face said carrier roller for pinching said recording medium;

a carriage for supporting said recording head above said recording medium conveyed by said carrier roller, said carriage being reciprocable in a direction intersecting a conveying direction of said recording medium;

a base unit for axially supporting said carrier roller;

a chassis connected with said base unit for supporting said carriage and said pinch roller, wherein said chassis is folded at upper and lower edge portions, and the folded parts of the upper and lower edge portions of said chassis serving as a guiding portion for slidably supporting said carriage.

9. A recording apparatus according to claim 8, further comprising:

a sheet-feeding tray enabling said recording medium to be stacked thereon;

a sheet-feeding roller for feeding one of said recording medium stacked on said sheet-feeding tray one by one to a nip between said carrier roller and said pinch roller, wherein one end of said sheet-feeding roller is axially supported by said chassis, and the othe rend thereof is axially supported by said base unit.

10. A recording apparatus according to claim 8, further comprising a sheet-expeller roller for expelling the recording medium, being supported by the base unit and being driven to rotate.

11. A recording apparatus according to claim 10, further comprising a main case unit axially supporting a spur which is arranged to face the sheet-expeller roller.

* * * * *

UNITED STATES PATENT AND TRADEMARK OFFICE

CERTIFICATE OF CORRECTION

PATENT NO. : 6,827,436 B2
DATED : December 7, 2004
INVENTOR(S) : Tetsuhiro Nitta et al.

It is certified that error appears in the above-identified patent and that said Letters Patent is hereby corrected as shown below:

Column 9,
Line 43, “blae 119” should read -- blade 119 --.
Line 47, “wiper” should read -- wipe --.

Column 13,
Line 44, “lest” should read -- least --.

Column 14,
Line 38, “othe rend” should read -- other end --.

Signed and Sealed this

Seventeenth Day of May, 2005

JON W. DUDAS
*Director of the United States Patent and Trademark Office*